US011485607B2

(12) United States Patent
Ylä-Soininmäki

(10) Patent No.: US 11,485,607 B2
(45) Date of Patent: Nov. 1, 2022

(54) CONTROL OF A GENERATION OF AN ELEVATOR LANDING CALL

(71) Applicant: KONE CORPORATION, Helsinki (FI)

(72) Inventor: Lassi Ylä-Soininmäki, Helsinki (FI)

(73) Assignee: KONE CORPORATION, Helsinki (FI)

( * ) Notice: Subject to any disclaimer, the term of this patent is extended or adjusted under 35 U.S.C. 154(b) by 796 days.

(21) Appl. No.: 16/454,645

(22) Filed: Jun. 27, 2019

(65) Prior Publication Data

US 2019/0315594 A1 Oct. 17, 2019

Related U.S. Application Data

(63) Continuation of application No. PCT/FI2017/050133, filed on Mar. 1, 2017.

(51) Int. Cl.
*B66B 1/16* (2006.01)
*B66B 1/46* (2006.01)

(52) U.S. Cl.
CPC ..... *B66B 1/468* (2013.01); *B66B 2201/4638* (2013.01); *B66B 2201/4653* (2013.01)

(58) Field of Classification Search
CPC ..... B66B 1/468; B66B 2201/4638; B66B 2201/4653
USPC ..... 187/380
See application file for complete search history.

(56) References Cited

U.S. PATENT DOCUMENTS 4,246,983 A * 1/1981 Bril ..... B66B 1/16 187/247
4,568,909 A * 2/1986 Whynacht ..... B66B 5/0025 187/393
4,630,026 A * 12/1986 Lewis ..... B66B 3/023 340/12.15
5,780,787 A * 7/1998 Kamani ..... B66B 13/143 187/390

(Continued)

FOREIGN PATENT DOCUMENTS

CN 1362934 A 8/2002
CN 105967008 A 9/2016

(Continued)

OTHER PUBLICATIONS

International Search Report, issued in PCT/FI2017/050133, dated Nov. 10, 2017.

(Continued)

*Primary Examiner* — Mahendra R Patel
(74) *Attorney, Agent, or Firm* — Birch, Stewart, Kolasch & Birch, LLP

(57) ABSTRACT

The solution relates to controlling a generation of an elevator landing call. In the solution, at least two different types of sensors are monitored. In response to a detection that the at least one first type sensor generates an indication on a detection, data indicating a detection by the at least one second type sensor is inquired. If the data inquired does not indicate the detection by the at least one second type sensor a signal is generated causing the generation of the elevator landing call. If the data inquired indicates the detection generated by the at least one second type sensor a generation of the signal causing the generation of the elevator landing call is prevented.

17 Claims, 4 Drawing Sheets

(56) References Cited

U.S. PATENT DOCUMENTS

| | | | | |
|---|---|---|---|---|
| 5,984,051 | A * | 11/1999 | Morgan | B66B 1/2408 187/316 |
| 6,209,685 | B1 | 4/2001 | Zaharia et al. | |
| 7,552,800 | B2 * | 6/2009 | Puskala | B66B 1/468 187/392 |
| 9,580,276 | B2 * | 2/2017 | Toutaoui | B66B 5/0025 |
| 10,683,190 | B2 * | 6/2020 | Chapman | B66B 1/468 |
| 10,934,132 | B2 | 3/2021 | Troesch et al. | |
| 2009/0166134 | A1 * | 7/2009 | Jahkonen | B66B 1/3492 187/394 |
| 2013/0048436 | A1 * | 2/2013 | Chan | B66B 1/2408 187/387 |

FOREIGN PATENT DOCUMENTS

| | | | | |
|---|---|---|---|---|
| CN | 107848737 | B * | 4/2021 | B66B 1/468 |
| JP | 2010-89953 | A | 4/2010 | |
| JP | 2014065603 | A * | 4/2014 | |
| JP | 5683019 | B2 * | 3/2015 | |
| JP | 2015-105189 | A | 6/2015 | |
| JP | 6194059 | B1 * | 9/2017 | B66B 1/3446 |
| WO | WO 00/75062 | A1 | 12/2000 | |
| WO | WO 2007/026042 | A2 | 3/2007 | |
| WO | WO 2016/198548 | A1 | 12/2016 | |

OTHER PUBLICATIONS

Written Opinion of the International Searching Authority, issued in PCT/FI2017/050133, dated Nov. 10, 2017.

* cited by examiner

| | Sensors | | | | | | | |
|---|---|---|---|---|---|---|---|---|
| | 120A | 120B | 120C | 120D | 130A | 130B | 130C | No signal |
| **Rule 1** | X | | X | | | X | | X |
| **Rule 2** | X | | | | X | X | | X |
| **Rule 3** | | X | | X | | X | X | X |
| **Rule 4** | | | | X | | | X | X |

CONTROL OF A GENERATION OF AN ELEVATOR LANDING CALL

CROSS REFERENCE TO RELATED APPLICATIONS

This application is a Continuation of PCT International Application No. PCT/FI2017/050133, filed on Mar. 1, 2017, which is hereby expressly incorporated by reference into the present application.

TECHNICAL FIELD

The invention concerns in general the technical field of elevators. More particularly, the invention concerns elevator call solutions.

BACKGROUND

Calling of elevator in a building shall be made as easy as possible, but at the same time it shall be efficiently implemented. The efficiency in the present context shall be understood at least to cover implementations in which the elevator waiting time is optimized, typically minimized.

Commonly known solution for implementing the elevator landing call in order to get the elevator to the floor from which a passenger aims to start traveling is an arrangement wherein a user interaction device, such as a button or a touch screen, is arranged in a vicinity of an elevator door. When the passenger enters to an area he/she orders the elevator by interacting with the device in question and the elevator arrives in the floor from which the landing call is given. In some implementations the landing call may also comprise information on a destination floor. In such an implementation the user interaction device may comprise means by means of which it is possible to indicate the destination floor, which at the same time generates the landing call to the elevator. As may be directly understood this kind of solutions have a drawback in that the waiting time of the elevator may turn out to be long, since the elevator is ordered not earlier than when the user performs the interaction with the calling system.

There are also developed solutions in which the landing call is done in response to a detection of a person in a location into which a sensor coupled to an elevator system is mounted to. In other words, the landing call of an elevator is generated automatically in response to a detection that a person is in an operational area of a sensor. This kind of solution is disclosed in a document WO 2007/026042 in which a passenger's arrival to the elevator area is detected by a plurality of sensors positioned at different distances from the elevator. Detection by the first sensor causes a generation of a call to serve the passenger and wherein the call is confirmed if detection with the second sensor is also made. This kind of arrangement may reduce the waiting time of an elevator, but at the same time it may cause false landing calls due to a fact that the sensors may detect different persons who are wandering within an operational area of the sensors, but who are not in a need of the elevator.

Hence, there is need to introduce further solutions in the area of elevator systems, which may mitigate the drawbacks of the existing solutions at least in part.

SUMMARY

The following presents a simplified summary in order to provide basic understanding of some aspects of various invention embodiments. The summary is not an extensive overview of the invention. It is neither intended to identify key or critical elements of the invention nor to delineate the scope of the invention. The following summary merely presents some concepts of the invention in a simplified form as a prelude to a more detailed description of exemplifying embodiments of the invention.

An objective of the invention is to present a method, a control device, a system and a computer program product for controlling a generation of a control signal for an elevator. Another objective of the invention is that the method, the control device, the system and the computer program product enable an optimized mechanism to generate an elevator landing call.

The objectives of the invention are reached by a method, a control device, a system and a computer program product as defined by the respective independent claims.

According to a first aspect, a method for controlling a generation of an elevator landing call is provided, the method comprises: monitoring at least one first type sensor and at least one second type sensor; inquiring, from a memory, in response to a detection that the at least one first type sensor generates an indication on a detection of an object in an operational area of the at least one first type sensor, data indicating a detection of an object generated by the at least one second type sensor; if the data inquired from the memory does not indicate the detection of an object generated by the at least one second type of sensor generating a signal causing the generation of the elevator landing call; and if the data inquired from the memory indicates the detection of an object generated by the at least one second type of sensor preventing a generation of the signal causing the generation of the elevator landing call.

The method may further comprise: generating a data record defining at least one rule for deciding if the signal is to be generated. The at least one rule may be generated so that it defines at least one of the following: a combination of at least one first type sensor and at least one second type sensor to be taken into account for deciding if the signal causing the generation of the elevator landing call is to be generated, a period of time defining a delay for generating the signal causing the generation of the elevator landing call in response to the detection that the at least one first type sensor generated an indication on a detection. The combination of the at least one first type sensor and at least one second type sensor is defined on a basis of sensor locations in a space in question.

Moreover, the sensor generating the indication on detection may be identified based on information included in a signal received from the sensor in question in response to detection. For example, the identification may be based on at least one of the following: a sensor specific identifier included in the signal, a sensor specific signal pattern. The generation of the signal causing the generation of the elevator landing call may comprise a determination of a location to which the elevator is to be called at least in part on a basis of the identification of the at least one first type sensor indicating the detection and including data representing the location in the signal.

The indication on detection by at least one of the sensor types may be based on detection of a beacon signal broadcast by a device carried by an object in the at least one sensor type.

According to a second aspect, a control device for controlling a generation of an elevator landing call is provided, the control device comprising: at least one processor; at least one memory including computer program code; the at least one memory and the computer program code configured to, with the at least one processor, cause the control device to perform: monitor at least one first type sensor and at least one second type sensor; inquire, from the memory, in response to a detection that the at least one first type sensor generates an indication on a detection of an object in an operational area of the at least one first type sensor, data indicating a detection of an object generated by the at least one second type sensor; generate a signal causing the generation of the elevator landing call if the data inquired from the memory does not indicate the detection of an object generated by the at least one second type sensor; and prevent a generation of the signal causing the generation of the elevator landing call if the data inquired from the memory indicates the detection of an object generated by the at least one second type sensor.

The control device may further be caused to perform: generate a data record defining at least one rule for deciding if the signal is to be generated. The control device may be configured to generate the at least one rule so that the rule defines at least one of the following: a combination of at least one first type sensor and at least one second type sensor to be taken into account for deciding if the signal causing the generation of the elevator landing call is to be generated, a period of time defining a delay for generating the signal causing the generation of the elevator landing call in response to the detection that the at least one first type sensor generated an indication on a detection. The control device may further be configured to define the combination of the at least one first type sensor and at least one second type sensor on a basis of sensor locations in a space in question.

Moreover, the control device may be configured to identify the sensor generating the indication on detection based on information included in a signal received from the sensor in question in response to detection. The control device may be configured to base the identification on at least one of the following: a sensor specific identifier included in the signal, a sensor specific signal pattern. Further, the control device may be configured to determine, during the generation of the signal causing the generation of the elevator landing call comprises, a location to which the elevator is to be called at least in part on a basis of the identification of the at least one first type sensor indicating the detection and including data representing the location in the signal.

The control device may also be configured to base the indication on detection by at least one of the sensor types on detection of a beacon signal broadcast by a device carried by an object in the at least one sensor type.

According to a third aspect, a system for controlling a generation of an elevator landing call is provided, the system comprising: a control device; at least one first type sensor communicatively coupled to the control device; at least one second type sensor communicatively coupled to the control device; an elevator system; wherein the control device is configured to: monitor the at least one first type sensor and the at least one second type sensor; inquire, from a memory, in response to a detection that the at least one first type sensor generates an indication on a detection of an object in an operational area of the at least one first type sensor, data indicating a detection of an object generated by the at least one second type sensor; generate a signal to the elevator system causing the generation of the elevator landing call if the data inquired from the memory does not indicate the detection of an object generated by the at least one second type sensor; and prevent a generation of the signal causing the generation of the elevator landing call if the data inquired from the memory indicates the detection of an object generated by the at least one second type sensor.

According to a fourth aspect, a computer program product is provided wherein the computer program product comprising at least one computer-readable storage medium having computer-executable program code instructions stored therein for performing the method as described above when the computer program product is executed on a computer.

Various exemplifying and non-limiting embodiments of the invention both as to constructions and to methods of operation, together with additional objects and advantages thereof, will be best understood from the following description of specific exemplifying and non-limiting embodiments when read in connection with the accompanying drawings.

The verbs "to comprise" and "to include" are used in this document as open limitations that neither exclude nor require the existence of unrecited features. The features recited in dependent claims are mutually freely combinable unless otherwise explicitly stated. Furthermore, it is to be understood that the use of "a" or "an", i.e. a singular form, throughout this document does not exclude a plurality.

BRIEF DESCRIPTION OF FIGURES

The embodiments of the invention are illustrated by way of example, and not by way of limitation, in the figures of the accompanying drawings.

FIG. 1 illustrates schematically an example of an environment in which the present invention may be applied to.

FIG. 5 illustrates schematically another example of an environment in which the present invention may be applied to.

DESCRIPTION OF THE EXEMPLIFYING EMBODIMENTS

The specific examples provided in the description given below should not be construed as limiting the scope and/or the applicability of the appended claims. Lists and groups of examples provided in the description given below are not exhaustive unless otherwise explicitly stated.

Figure 1:
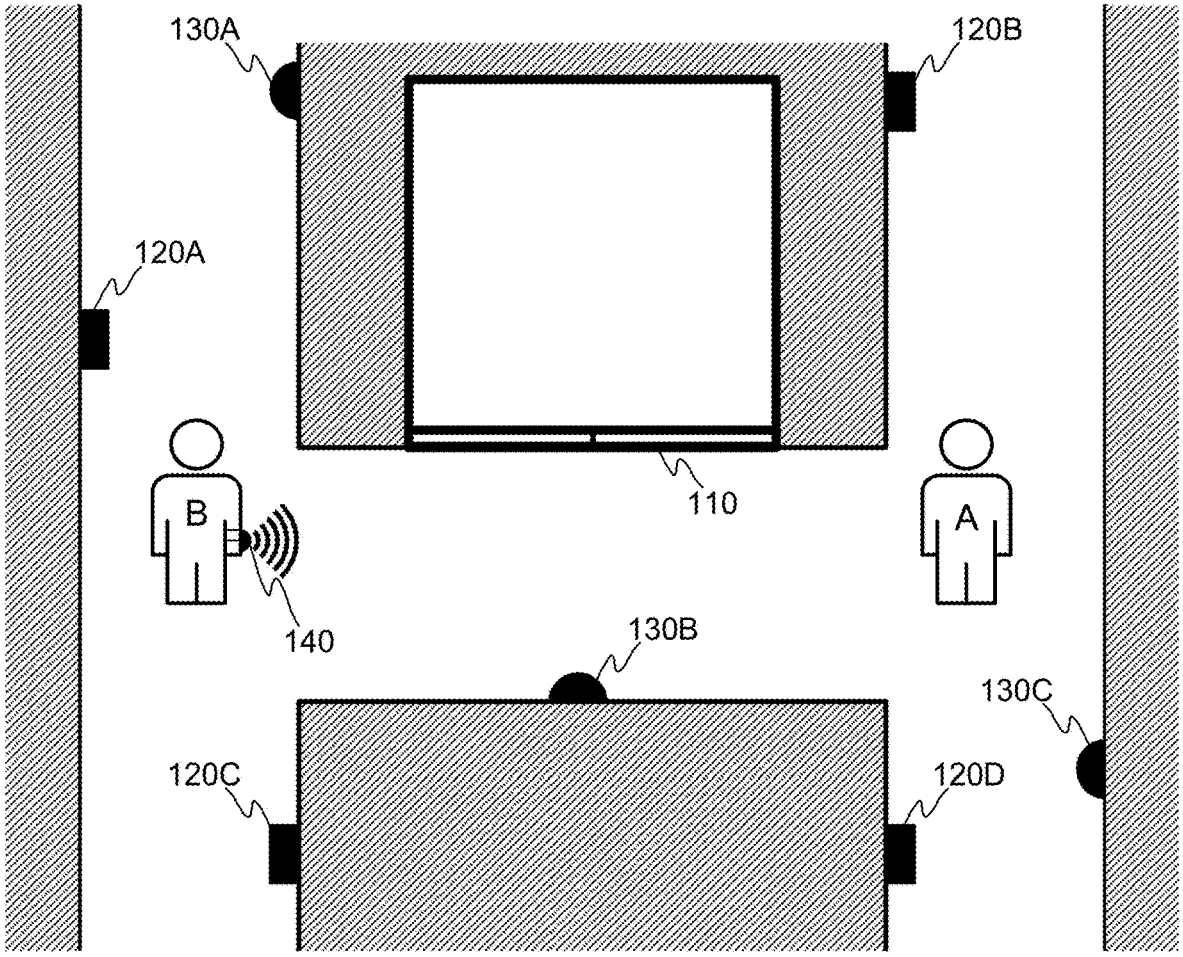

At least some aspects relating to a principle of the present invention are now discussed by referring to FIG. 1 which schematically illustrates an environment, such as a floor in a building equipped with one or more elevators 110, in which the present invention may be applied to. There may be installed sensors for detecting objects roaming in the building. In the example of FIG. 1 there are installed two different types of sensors i.e. first type sensors 120A, 120B, 120C, 120D and second type sensors 130A, 130B, 130C. In the building there roam objects, such as human beings, animals or robots. The objects in FIG. 1 are illustrated as human beings, referred with A, B. The objects may be categorized to at least two different groups, wherein at least one of the groups may only be detectable by the second type sensors 130A, 130B, 130C. For the purpose of describing the invention the objects detectable by the second type sensors 130A, 130B, 130C are equipped with a device 140 which may be configured to communicate with the second type sensor preferably in a wireless manner. In other words, the implementation is arranged so that the first type sensor 120A, 120B, 120C, 120D is configured to generate an indication on a detection of any object residing in an operational area of the first type sensor in question whereas the second type sensor 130A, 130B, 130C is only configured to generate an indication on a detection of any object being detectable to it when the object in question resides in an operational area of the second type sensor 130A, 130B, 130C. For sake of clarity such an object in this example may be such an object which is equipped with the device 140, as already mentioned. As a non-limiting example of the first type sensor may be mentioned infrared based sensor, such as a passive infrared sensor. As a non-limiting example of the second type sensor may be mentioned a short-range wireless communication receiver, such as Bluetooth receiver. Thus, the device 140 carried by the object B may be a transmitter transmitting a signal detectable by the receiver. For example, the transmitter may be a Bluetooth transmitter transmitting a beacon signal. In some implementation of the present invention the beacon signal may comprise an identifier for identifying the object B.

Figure 2:
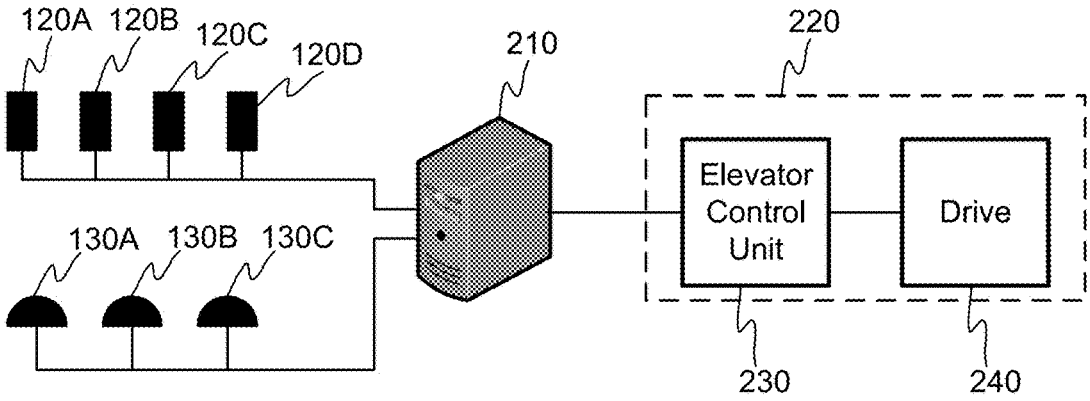
FIG. 2 illustrates schematically an example of a sensor system coupled to an elevator system according to an embodiment of the invention.

FIG. 2 schematically illustrates an example of a sensor system coupled to an elevator system 220. The example as illustrated in FIG. 2 comprises two groups of sensors, wherein the first group of sensors are the first type sensors 120A, 120B, 120C, 120D and the second group of sensors are the second type sensors 130A, 130B, 130C. The sensors are coupled, at least communicatively, to a control device 210, which is configured to monitor if any of the sensors generates an indication on a detection of an object in an operational area of the sensor in question. The indication shall be understood a signal generated by the sensor from which the control device 210 may, either directly or indirectly, determine that a detection of an object has occurred. The control device 210 may be configured to perform one or more operations based on which it may generate a signal to an elevator system 220, and to an elevator control unit 230 therein, which may be configured to control, at least in part, the elevator system 220. Especially, it may be configured to control a generation of one or more signals, such as an elevator landing calls, which may be directed to an elevator drive system 240 causing the elevator system to operate accordingly, such as causing an elevator car to travel to a location, such as a floor, indicated in the elevator landing call. In the example as depicted in FIG. 2 the control device 210 is configured to monitor both the first type sensors and the second type sensors, but it may also be arranged that each of the sensor groups are monitored by dedicated computing devices for each group, which are configured to transmit data to a central computing device in order to perform at least some of the operations as described. Moreover, in FIG. 2 the control device 210 and the elevator control unit 230 are illustrated as separate entities, but these may be combined in the same physical entity, which may be configured to perform functions in order to control a generation of an elevator landing call as will be described.

The control device 210, as schematically illustrated in FIG. 2, may be configured to monitor and master sensors in a plurality of locations and floors in a building. Advantageously, the control device 210 may be configured to identify the sensor from which a signal indicating detection is received. The identification of the sensor may e.g. be arranged so that the sensors are configured to include an identifier in the signal indicating the detection, whereas the control device 210 may e.g. maintain a data record on the locations with respect to each sensor. In this manner the control device 210 may e.g. determine if two or more detections e.g. origin sensors location within a predetermined distance from other. The identification of the sensors may also be based on other identification mechanisms than the inclusion of the sensor identifier in the signal. For example, sensors may generate individual signal pattern from which the control device 210 may identify the sensor providing the indication on detection. As said, the identification of the sensor is not limited to the examples given above, but any other mechanism may also be applied to.

Figure 3:
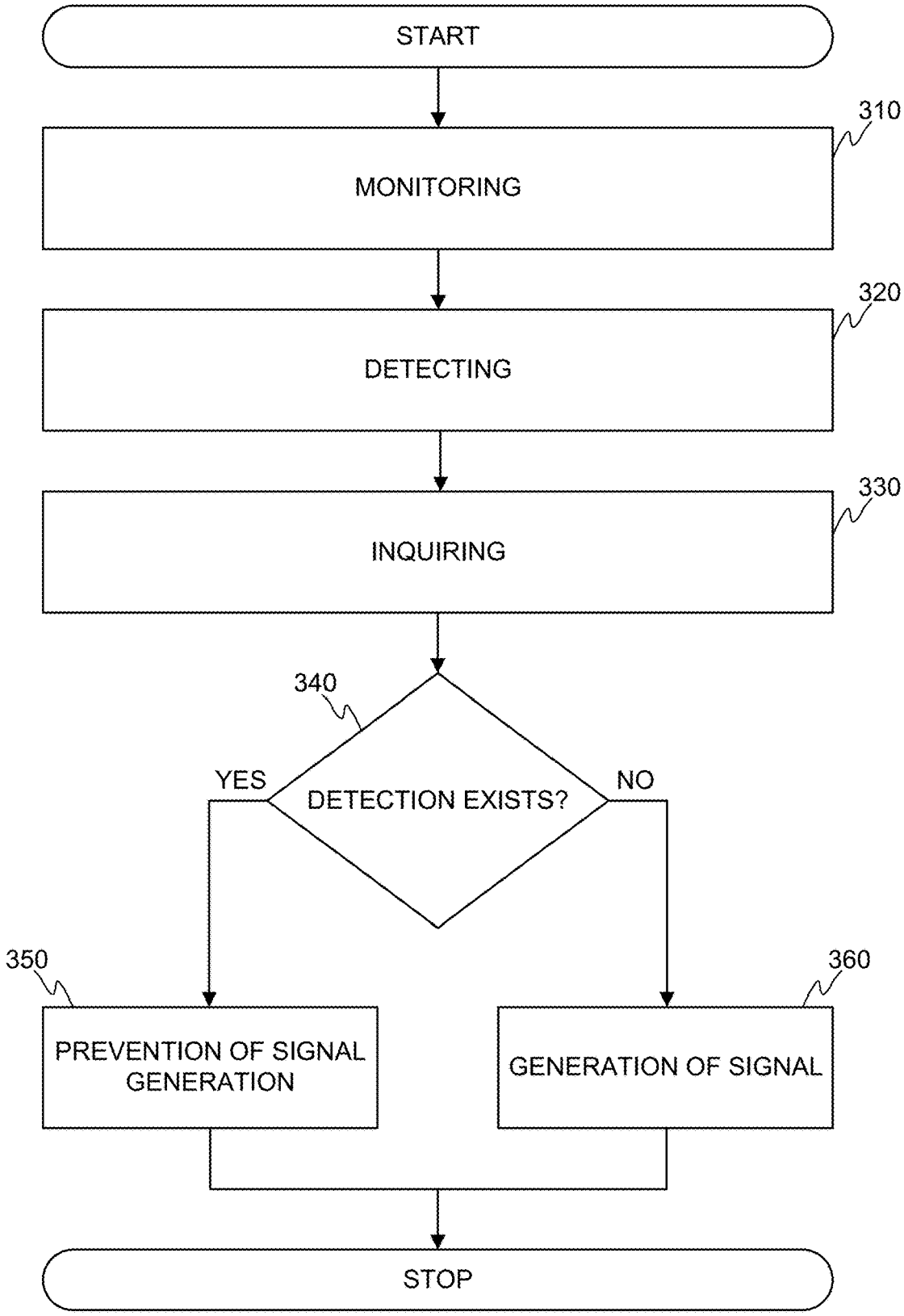
FIG. 3 illustrates schematically a method according to an embodiment of the invention.

Next a principle of the invention is described by referring to FIG. 3, which schematically illustrates at least some aspects of a method according to an embodiment of the invention.

Regarding step 310:

In step 310 the control device 210 may be configured to monitor occurrences detected by sensors. In other words, the control device 310 may be configured to monitor if any of the sensors being coupled to the control device 310 detects an object through a detection mechanism specific to the sensor in question. As described the control device 210 may be configured to monitor 310 at least one first type sensor 120A, 120B, 120C, 120D and at least one second type sensor 130A, 130B, 130C.

The monitoring may be implemented e.g. so that the control device 210 is arranged in a state in which it receives a signal from at least one sensor in response to detection of an object in an operational area of the sensor in question. Alternatively, the control device 210 may be configured to obtain information from the sensors according to a predetermined time scheme, such as by polling the status of the sensors. Moreover, some sensors may comprise a buffer memory into which information on detection by sensor element may at least temporarily be stored and from which the control device 210 may obtain information on detection done by a sensor in question.

The control device 210 may be configured to store data indicating at least one detection done by at least one second type sensor in a memory. The memory may reside in the control device 210 or be an external entity to the control device 210. The data may be stored either permanently or temporarily. In some embodiment of the invention the control unit 210 may be configured to store data indicating at least one detection done by at least one first type sensor in the memory. The same may be arranged if there are further types of sensors included in the sensor system.

Regarding step 320:

The control device 210 may be configured to detect 320 if an indication on a detection of an object is performed by at least one first type sensor 120A, 120B, 120C, 120D. In practice, the control device 210 may be configured to obtain information from the at least one first type sensor e.g. in the manner as described in the context of the previous step and to determine if the information indicates a detection by the at least one first type sensor 120A, 120B, 120C, 120D. The determination may e.g. be based a change in signal obtained from the at least on first type sensor or data carried in the signal from the at least one first type sensor 120A, 1208, 120C, 120D.

Regarding step 330:

In response to a detection 320 that at least one indication on a detection of an object by the at least one first type sensor 120A, 120B, 120C, 120D is obtained the control device 210 may be configured to inquiry from the memory if the memory stores data indicating that the at least one second type sensor 130A, 130B, 130C has detected an object. The inquiry may comprise one or more parameters defining data, which is to be included in the response. For example, the parameters may define a period of time for detections on which data is inquired from the memory. Alternatively or in addition, the parameters may define, e.g. identify, one or more second type sensors 130A, 1308, 130C on the detections of which data is inquired from the memory. In other words, the control device 210 may, at some point of time, obtain an indication on detection done by one first type sensor and in response to it the control device 210 may be configured to determine, based on information accessible by it, the relevant second type sensor(s) 130A, 130B, 130C whose possible detections shall be determined. For example, the relevant second type sensor(s) 130A, 130B, 130C may be determined on a location basis e.g. with respect to the one first type sensor 120A, 120B, 120C, 120D, which generated the indication on the detection. According to some further embodiment of the invention the control device 210 may be configured to obtain all data from the memory for an analysis.

All in all, in response to the inquiry 330 the control device 210 may obtain information, i.e. data, on any indication on detection of an object by at least one second type sensor 130A, 130B, 130C from the memory storing such data.

Regarding step 340:

Next, the control device 210 may be configured to analyze 340 from the response if one or more indications on detections done by the at least one second type sensor 130A, 130B, 130C exists in the memory. Moreover, the control device 210 may be configured to perform the analysis based on some predetermined rules defined in the control device 210. For example, the rules may define some parameters for the detections to be taken into account in the analysis based e.g. on time related aspects or location related aspects or the both as a non-limiting examples. In other words, the control device 210 may be configured to perform predetermined operations, such as filtering, to the data obtained from the memory. Alternatively, the same may be achieved by defining rules, or limitations, as parameters in the inquiry, as already described, in which the response to the inquiry only carries data relevant to the situation in question.

As an outcome of the analysis 340 the control device 210 may be configured to determine if there is stored one or more indications on one or more detections done by the at least one second type sensor 130A, 130B, 130C, which fulfill one or more rules possibly defined for the detections.

Regarding step 350:

In case the outcome from step 340 is that the memory stores one or more applicable indications on detections done by one or more second type sensors 130A, 130B, 130C the control device 210 may be configured to determine that there is no need to cause a generation of an elevator landing call. In other words, the control device 210 may be configured to prevent any initiation of the elevator landing call generation in response to the detection done by the at least one first type sensor 120A, 1208, 120C, 120D. In practice, the prevention of the generation of the elevator landing call may e.g. be arranged by configuring the control device 210 to maintain the state of the signal to the elevator control unit 230 even if an indication on the detection by the at least one first type sensor 120A, 120B, 120C, 120D is obtained through the monitoring 310 when applicable indications on detections done by at least one second type sensor 130A, 130B, 130C exist in the memory.

Regarding step 360:

Alternatively to the step 350 the outcome of the step 340 may be that the memory does not store data, which indicates any applicable detection generated by at least one second type of sensor. In such a situation the control device 210 shall conclude that there exists an object, such as a person, who may need an elevator. In response to the outcome the control unit 210 is configured to generate a signal which causes a generation of an elevator landing call 360. The signal may advantageously carry an indication on a location where the elevator shall arrive. The control device 210 may derive this piece of information from the sensor generating the indication on the detection, for example, and to include it to the signal.

Depending on the implementation of the present invention the control device 210 may generate the signal to the elevator control unit 230 which causes the elevator control unit 230 to generate the elevator landing call. In case, the implementation of the present invention is such that the control device 210 and the elevator control unit 230 are implemented in the same entity the elevator landing call is generated by the entity in response to the corresponding outcome from the analysis 340.

Figures 4, 6:
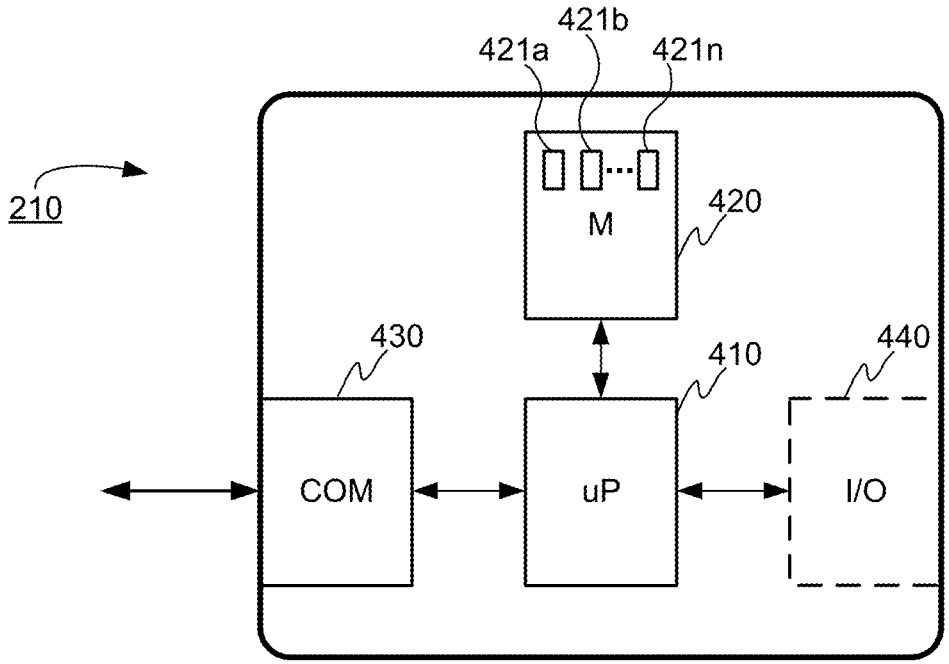
FIG. 4 illustrates schematically an example of a control device according to an embodiment of the invention.
FIG. 6 illustrates schematically an example of a data record defining rules to be applied in the context of at least one embodiment of the invention.

FIG. 4 illustrates schematically a control device 210 according to an example of the invention. The control device 210 may be configured to implement the method as described at least in part. The execution of the method may be achieved by arranging the processor 410 to execute at least some portion of computer program code 421*a*-421*n* stored in a memory 420 causing the processor 410, and, thus, the control device 210, to implement one or more method steps as described. Hence, the processor 410 may be arranged to access the memory 420 and to retrieve and to store any information therefrom and thereto. Moreover, the processor 410 may be configured to control the communication through the communication interface 430 with any external unit, such as with at least one of the following: sensors, elevator control unit, external data storage and so on. Hence, the communication interface 430 may be arranged to implement, possibly under control of the processor 410, a corresponding communication protocol between an external entity in question.

Further, the control device 210 may comprise one or more input/output devices 440 for inputting and outputting information. Such input/output devices may e.g. be keyboard, buttons, touch screen, display, loudspeaker and so on. In some implementation of the control device at least some of the input/output devices may be external to the control device and coupled to it either wirelessly or in a wired manner. For sake of clarity, the processor herein refers to any unit or a plurality of units suitable for processing information and control the operation of the control device and the system in general at least in part, among other tasks. The mentioned operations may e.g. be implemented with a microcontroller solution with embedded software. Similarly, the invention is not limited to a certain type of memory only, but any memory unit or a plurality of memory units type suitable for storing the described pieces of information, such as portions of computer program code and/or parameters usable in the context of the present method, may be applied in the context of the present invention. Even if it is disclosed that the method may be implemented with one control device 210, it may also be arranged that implementation of the method is performed in multiple control devices operatively coupled to each other either directly or indirectly as a distributed implementation. In case the control device 210 is integrated with the elevator control unit the entity may comprise further units specific to elevator environment.

Figure 5:
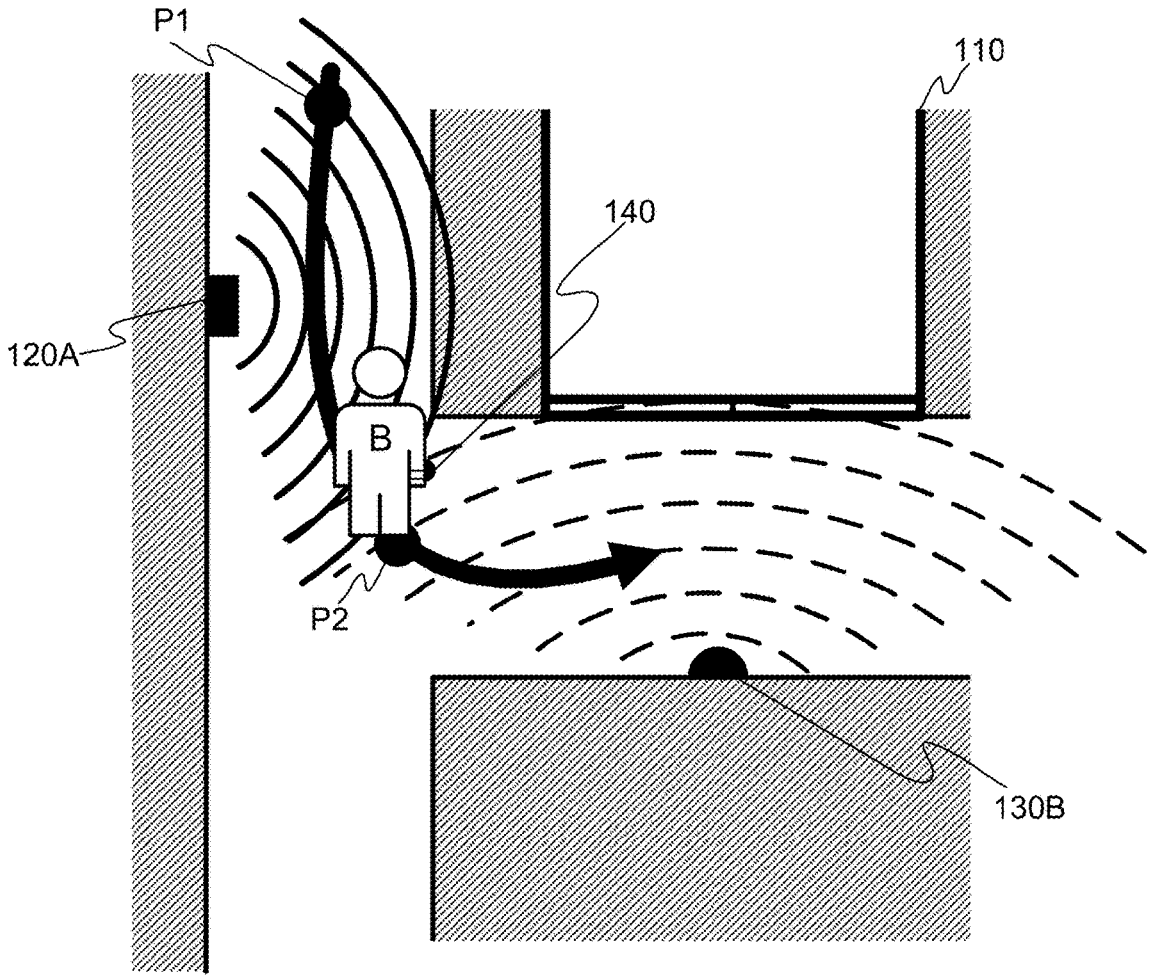

Now, some aspects of the present invention are described by referring to FIG. 5, which schematically illustrates a simplified version of an environment of FIG. 1. In the example of FIG. 5 there is one elevator 110 for serving passengers in the building, one first type sensor 120A and one second type sensor 130B. The person B is carrying a device 140, which in the present example is configured to broadcast a beacon signal detectable by the sensor 130B. In FIG. 5 it is schematically illustrated an operational area of the first type sensor 120A with wave pattern drawn with solid lines and an operational area of the second type sensor 130B with wave pattern drawn with dashed lines. For sake of clarity, the operational area as regards to the second type sensor 130B is, as a matter of fact, defined by a broadcast range of device 140, but for describing at least some aspects of the present invention the operational area is considered as an operational area of the second type sensor 130B since the range remains the same and is defined by the range of the communication connection between the device 140 and the second type sensor 130B. Further, a path the person B is roaming is also illustrated in FIG. 5 as a solid arrow. First, the person B roams in the corridor and at some point P1 the person enters an operational area of the first type sensor 120A (wave pattern drawn with solid lines) and the first type sensor 120A generates an indication on a detection of the person to the control device 210. The control device 210 initiates the method as described and checks if a memory comprises indications on a detection done by at least one second type sensor. This is not the case until the person B roams to the operational area of the second type sensor 130B (wave pattern drawn with dashed lines). Such a position is marked with a position P2 in FIG. 5. As a result, the sensor generates an indication on the detection by the second type sensor 130B to the control device 210, and in the memory therein. Hence, for optimizing the operation of the present invention it may be advantageous, in at least some implementations of the present invention, to set a delay to a generation of a signal causing an elevator landing call based on the detection by at least one first type sensor 120A. The delay may e.g. be determined by providing estimation on a time it takes, e.g. on average, to an object, such as a person, to move from a position causing a first detection by the first type sensor 120A to a position causing a first detection by the second type sensor 130B. In the determination of the delay may also be taken into account the type of person carrying the device, which refers to an understanding that a certain type of person, such as a cleaning person, may spend a specific amount of time in a certain location for performing typical acts defined for her/him. As a result, the control device 210 may be configured to delay the generation of the signal until the determined delay is passed and no indications on detection by the second type sensor 130B is received in the control device 210, and specifically stored in the memory accessible by the control device 210. In other words, if the person in the example of FIG. 5 is not equipped with the device 140 an enter to the operational area of the second type sensor 130B does not cause detection by the second type sensor 130B even if the delay for generating a signal is set, and when the delay has passed the elevator landing call may be generated through the signal generation in the control device 210. For sake of clarity it is worthwhile to mention that the present invention is not only limited to solutions in which the operational areas of the different sensor types are overlapping and the detection shall be made concurrently by the different sensor types for preventing the generation of signal even though it may bring, at least in some environments, some advantages in the detection.

Still more sophisticated implementations may be established for making a decision if the signal shall be generated by the control device 210 or not. For example, a data record defining a first type sensor and a second type sensor groups may be established. The purpose of the groups may e.g. be that they define rules if the signal is to be generated or not. FIG. 6 illustrates schematically a non-limiting example of a data record defining at least some rules for preventing a generation of the signal in response to detections done by first type sensors 120A, 120B, 120C, 120D and/or second type sensors 130A, 130B, 130C. The example of FIG. 6 is derived for an implementation of the system as schematically depicted in FIG. 1. The principle of the utilization of the rules is that if at least one of the first type sensors defined for the rule in question generates an indication on detection and if at least one of the second type sensors defined for the rule in question generates an indication on detection the generation of the signal is prevented. For example, by having a look to Rule 3 if either the first type sensor 120B or the first type sensor 120D generates the indication on detection it is next checked if either the second type sensor 130B or the second type sensor 130C is also generating an indication the generation of the signal for causing the elevator landing call is prevented. If no indication on detection from any of the second type sensors defined for the rule is received, the signal for causing the elevator landing call is generated. The same fundamental idea applies to other rules. Furthermore, it is possible to define delays on a rule by rule basis which delay has to be taken into account by the control device 210 before generating the signal. Such delays may be defined either as an only rule or together with the location based thinking as schematically illustrated in FIG. 6. In other words, the implementation of the present invention may be arranged to take into account at least some probability aspects relating to the generation of indications of some sensor(s) together with some other sensor(s) in a context of a certain object. In the described manner the control device 210 may be configured to take into account either spatial matters of the sensors or temporal matters relating to indications or both.

Some aspects of the present invention relate to a system for controlling a generation of an elevator landing call. The system according to an embodiment of the invention comprises a control device 210, at least one first type sensor 120A, 120B, 120C, 120D communicatively coupled to the control device 210, at least one second type sensor 130A, 130B, 130C communicatively coupled to the control device 210, and an elevator system 220, such as the one described in the context of FIG. 2. In the system the control device 210 may be configured to: monitor 310 the at least one first type sensor 120A, 120B, 120C, 120D and the at least one second type sensor 130A, 1308, 130C; inquire 330, from a memory 420, in response to a detection 320 that the at least one first type sensor 120A, 1208, 120C, 120D generates an indication on a detection of an object in an operational area of the at least one first type sensor 120A, 120B, 120C, 120D, data indicating a detection of an object generated by the at least one second type sensor 130A, 130B, 130C; generate a signal 360 to the elevator system 220 causing the generation of the elevator landing call if the data inquired from the memory does not indicate the detection of an object generated by the at least one second type sensor 130A, 1308, 130C; and prevent a generation of the signal 350 causing the generation of the elevator landing call if the data inquired from the memory indicates the detection of an object generated by the at least one second type sensor 130A, 1308, 130C. Further, the system may be configured to perform the method as described.

Some still further aspects of the present invention relate to a computer program product comprising at least one computer-readable storage medium having computer-executable program code instructions stored therein for performing the method as described herein when the computer program product is executed on a computer. The computer may refer, but is not limited to, at least one processor 410 of the control device 210.

In the description of at least some aspects of the invention it is indicated that the first type sensors may be based on infrared detection and the second type sensors may be Bluetooth receivers detecting a beacon signal broadcast by the device 140. However, the invention is not limited to these sensor types only, but any other sensor arrangement may be used as long as it is possible to differentiate the detections of the objects in some manner.

Further, according to some embodiment of the invention the signal causing the elevator landing call may be arranged so that the landing call causes the elevator to arrive in the destination floor, but the elevator doors are not opened. This kind of arrangement offers a possibility to pre-order the elevator in the destination floor based on the sensor system as described, but the final call may be performed by a further interaction by the passenger and the elevator system. For example, the passenger may confirm the elevator call with a user interaction device, such as a button or a touch screen, locating on the floor e.g. beside the elevator doors. In response to the user interaction the elevator doors are opened and the passenger may use the elevator service. This kind of arrangement improves the service experience as the waiting time of the elevator may be reduced based on the detections made by the sensor system.

The pre-ordering system, as described in the previous paragraph, may be further developed so that different priorities may be assigned to different types of elevator calls. For example, the priority of the elevator landing call in response to an appropriate detection by the sensor system, and thus the control device 210, may be assigned with another priority than an elevator landing call given through the user interaction device. In some embodiment of the invention the elevator landing call given through the user interaction device is assigned with a higher priority than the elevator landing call triggered through the sensor system by the control device 210. This kind of arrangement enables a solution in which the passengers ordering the elevator through the user interaction device are always served first even if there exists elevator landing calls generated through the detection by the control device 210. In this manner it is possible to reduce, at least in part, a number of possible false calls generated by the sensor system, but at the same time the elevator waiting time may be reduced.

The specific examples provided in the description given above should not be construed as limiting the applicability and/or the interpretation of the appended claims. Lists and groups of examples provided in the description given above are not exhaustive unless otherwise explicitly stated.

What is claimed is:

1. A method for controlling a generation of an elevator landing call, the method comprising the steps of:

monitoring at least one first type sensor and at least one second type sensor;

inquiring, from a memory, in response to a detection that the at least one first type sensor generates an indication on a detection of an object in an operational area of the at least one first type sensor, data indicating a detection of an object generated by the at least one second type sensor;

if the data inquired from the memory does not indicate the detection of an object generated by the at least one second type sensor generating a signal causing the generation of the elevator landing call; and if the data inquired from the memory indicates the detection of an object generated by the at least one second type sensor preventing a generation of the signal causing the generation of the elevator landing call, wherein the sensor generating the indication on detection is identified based on information included in a signal received from the sensor in question in response to detection, wherein the identification is based on at least one of the following:

a sensor specific identifier included in the signal; and a sensor specific signal pattern, and wherein the generation of the signal causing the generation of the elevator landing call comprises a determination of a location to which the elevator is to be called at least in part on a basis of the identification of the at least one first type sensor indicating the detection and including data representing the location in the signal.

2. The method of claim 1, the method further comprising:

generating a data record defining at least one rule for deciding if the signal is to be generated.

3. The method of claim 2, wherein the at least one rule is generated so that it defines at least one of the following: a combination of at least one first type sensor and at least one second type sensor to be taken into account for deciding if the signal causing the generation of the elevator landing call is to be generated, a period of time defining a delay for generating the signal causing the generation of the elevator landing call in response to the detection that the at least one first type sensor generated an indication on a detection.

4. The method of claim 3, wherein the combination of the at least one first type sensor and at least one second type sensor is defined on a basis of sensor locations in a space in question.

5. The method of claim 1, wherein the indication on detection by at least one of the sensor types is based on detection of a beacon signal broadcast by a device carried by an object in the at least one sensor type.

6. A control device for controlling a generation of an elevator landing call, the control device comprising:

at least one processor; and at least one memory including computer program code, wherein the at least one memory and the computer program code are configured to, with the at least one processor, cause the control device to:

monitor at least one first type sensor and at least one second type sensor;

inquire, from the memory, in response to a detection that the at least one first type sensor generates an indication on a detection of an object in an operational area of the at least one first type sensor, data indicating a detection of an object generated by the at least one second type sensor;

generate a signal causing the generation of the elevator landing call if the data inquired from the memory does not indicate the detection of an object generated by the at least one second type sensor; and prevent a generation of the signal causing the generation of the elevator landing call if the data inquired from the memory indicates the detection of an object generated by the at least one second type sensor, wherein the sensor generating the indication on detection is identified based on information included in a signal received from the sensor in question in response to detection, wherein the identification is based on at least one of the following:

a sensor specific identifier included in the signal; and a sensor specific signal pattern, and wherein the generation of the signal causing the generation of the elevator landing call comprises a determination of a location to which the elevator is to be called at least in part on a basis of the identification of the at least one first type sensor indicating the detection and including data representing the location in the signal.

7. The control device of claim 6, wherein the control device is further caused to:

generate a data record defining at least one rule for deciding if the signal is to be generated.

8. The control device of claim 7, wherein the control device is configured to generate the at least one rule so that the rule defines at least one of the following:

a combination of at least one first type sensor and at least one second type sensor to be taken into account for deciding if the signal causing the generation of the elevator landing call is to be generated, and a period of time defining a delay for generating the signal causing the generation of the elevator landing call in response to the detection that the at least one first type sensor generated an indication on a detection.

9. The control device of claim 8, wherein the control device is configured to define the combination of the at least one first type sensor and at least one second type sensor on a basis of sensor locations in a space in question.

10. The control device of claim 6, wherein the control device is configured to identify the sensor generating the indication on detection based on information included in a signal received from the sensor in question in response to detection.

11. The control device of claim 10, wherein the control device is configured to base the identification on at least one of the following: a sensor specific identifier included in the signal, a sensor specific signal pattern.

12. The control device of claim 10, wherein the control device is configured to determine, during the generation of the signal causing the generation of the elevator landing call comprises, a location to which the elevator is to be called at least in part on a basis of the identification of the at least one first type sensor indicating the detection and including data representing the location in the signal.

13. The control device of claim 6, wherein the control device is configured to base the indication on detection by at least one of the sensor types on detection of a beacon signal broadcast by a device carried by an object in the at least one sensor type.

14. A system for controlling a generation of an elevator landing call, the system comprising:

a control device;

at least one first type sensor communicatively coupled to the control device;

at least one second type sensor communicatively coupled to the control device; and an elevator system, wherein the control device is configured to:

monitor the at least one first type sensor and the at least one second type sensor;

inquire, from a memory, in response to a detection that the at least one first type sensor generates an indication on a detection of an object in an operational area of the at least one first type sensor, data indicating a detection of an object generated by the at least one second type sensor;

generate a signal to the elevator system causing the generation of the elevator landing call if the data inquired from the memory does not indicate the detection of an object generated by the at least one second type sensor; and prevent a generation of the signal causing the generation of the elevator landing call if the data inquired from the memory indicates the detection of an object generated by the at least one second type sensor, wherein the sensor generating the indication on detection is identified based on information included in a signal received from the sensor in question in response to detection, wherein the identification is based on at least one of the following:

a sensor specific identifier included in the signal; and a sensor specific signal pattern, and wherein the generation of the signal causing the generation of the elevator landing call comprises a determination of a location to which the elevator is to be called at least in part on a basis of the identification of the at least one first type sensor indicating the detection and including data representing the location in the signal.

15. A computer program product comprising at least one non-transitory computer-readable storage medium having computer-executable program code instructions stored therein for performing the method of claim 1 when the computer program product is executed on a computer.

16. The method of claim 2, wherein the sensor generating the indication on detection is identified based on information included in a signal received from the sensor in question in response to detection.

17. The method of claim 3, wherein the sensor generating the indication on detection is identified based on information included in a signal received from the sensor in question in response to detection.

* * * * *